US008505639B2

(12) United States Patent
Robison et al.

(10) Patent No.: US 8,505,639 B2
(45) Date of Patent: Aug. 13, 2013

(54) INDEXING SLEEVE FOR SINGLE-TRIP, MULTI-STAGE FRACING

(75) Inventors: Clark E. Robison, Tomball, TX (US); Robert Coon, Missouri City, TX (US); Robert Malloy, Katy, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 532 days.

(21) Appl. No.: 12/753,331

(22) Filed: Apr. 2, 2010

(65) Prior Publication Data

US 2011/0240311 A1 Oct. 6, 2011

(51) Int. Cl.
*E21B 33/12* (2006.01)
*E21B 34/06* (2006.01)

(52) U.S. Cl.
USPC ..... 166/386; 166/194; 166/195; 166/332.1

(58) Field of Classification Search
USPC ..... 166/386, 192–195, 332.1
See application file for complete search history.

(56) References Cited

U.S. PATENT DOCUMENTS

| | | | |
|---|---|---|---|
| 3,054,415 | A | 9/1962 | Baker et al. |
| 4,099,563 | A | 7/1978 | Hutchison et al. |
| 4,520,870 | A | 6/1985 | Pringle |
| 4,574,894 | A | 3/1986 | Jadwin |
| 4,823,882 | A | 4/1989 | Stokely et al. |
| 4,893,678 | A | 1/1990 | Stokely et al. |
| 4,907,649 | A | 3/1990 | Bode |
| 4,967,841 | A | 11/1990 | Murray |
| 5,082,062 | A | 1/1992 | Wood et al. |
| 5,146,992 | A | 9/1992 | Baugh |
| 5,244,044 | A | 9/1993 | Henderson |
| 5,499,687 | A | 3/1996 | Lee |
| 6,041,857 | A | 3/2000 | Carmody et al. |
| 6,155,350 | A | 12/2000 | Melenyzer |

(Continued)

FOREIGN PATENT DOCUMENTS

| | | |
|---|---|---|
| EP | 0618347 | 10/1994 |
| GB | 2402954 | 12/2004 |

(Continued)

OTHER PUBLICATIONS

European Search Report in counterpart EP Appl. No. EP 11 16 0133, dated Sep. 27, 2011.

(Continued)

*Primary Examiner* — Shane Bomar
*Assistant Examiner* — Catherine Loikith
(74) *Attorney, Agent, or Firm* — Wong, Cabello, Lutsch, Rutherford & Brucculeri, L.L.P.

(57) ABSTRACT

A sliding sleeve has a sensor that detects plugs (darts, balls, etc.) passing through the sleeves. A first insert on the sleeve can be hydraulically activated by the fluid pressure in the surrounding annulus once a preset number of plugs have passed through the sleeve. Movement of this first insert activates a catch on a second insert. Once the next plug is deployed, the catch engages it so that fluid pressure applied against the seated plug through the tubing string can moves the second insert. Once moved, the insert reveals port in the housing communicating the sleeve's bore with the surrounding annulus so an adjacent wellbore interval can be stimulated. The first insert may also be hydraulically activated after a preset time after a plug has passed through the sleeve. Several sleeves can be used together in various arrangements to treat multiple intervals of a wellbore.

52 Claims, 9 Drawing Sheets

(56) References Cited

U.S. PATENT DOCUMENTS

| | | | | |
|---|---|---|---|---|
| 6,172,614 | B1 | 1/2001 | Robison et al. | |
| 6,253,861 | B1 | 7/2001 | Carmichael et al. | |
| 6,343,649 | B1 * | 2/2002 | Beck et al. | 166/250.01 |
| 6,349,766 | B1 | 2/2002 | Bussear et al. | |
| 6,464,008 | B1 | 10/2002 | Roddy et al. | |
| 6,491,097 | B1 | 12/2002 | Oneal et al. | |
| 6,634,428 | B2 | 10/2003 | Krauss | |
| 6,907,936 | B2 | 6/2005 | Fehr et al. | |
| 6,920,930 | B2 | 7/2005 | Allamon et al. | |
| 7,252,152 | B2 | 8/2007 | LoGiudice et al. | |
| 7,322,417 | B2 | 1/2008 | Rytlewski et al. | |
| 7,347,289 | B2 | 3/2008 | Lee | |
| 7,377,321 | B2 | 5/2008 | Rylewski | |
| 7,387,165 | B2 | 6/2008 | Lopez de Cardenas et al. | |
| 7,581,596 | B2 | 9/2009 | Reunert et al. | |
| 7,661,478 | B2 | 2/2010 | Palmer et al. | |
| 2001/0013410 | A1 * | 8/2001 | Beck et al. | 166/65.1 |
| 2003/0052670 | A1 | 3/2003 | Miszewski | |
| 2003/0075326 | A1 | 4/2003 | Ebinger | |
| 2003/0145986 | A1 * | 8/2003 | Evans et al. | 166/250.15 |
| 2006/0124310 | A1 | 6/2006 | Lopez de Cardenas et al. | |
| 2006/0207764 | A1 | 9/2006 | Rytlewski | |
| 2007/0204995 | A1 | 9/2007 | Hofman et al. | |
| 2007/0272411 | A1 | 11/2007 | Lopez de Cardenas et al. | |
| 2007/0272413 | A1 | 11/2007 | Rytlewski et al. | |
| 2007/0285275 | A1 | 12/2007 | Purkis et al. | |
| 2008/0053658 | A1 | 3/2008 | Wesson et al. | |
| 2009/0044949 | A1 | 2/2009 | King et al. | |
| 2009/0056934 | A1 | 3/2009 | Xu | |
| 2009/0084553 | A1 | 4/2009 | Rytlewski et al. | |
| 2009/0223663 | A1 | 9/2009 | Snider et al. | |
| 2009/0223670 | A1 | 9/2009 | Snider | |
| 2009/0308588 | A1 * | 12/2009 | Howell et al. | 166/66.4 |
| 2010/0155055 | A1 | 6/2010 | Ash et al. | |
| 2010/0282338 | A1 | 11/2010 | Gerrard et al. | |
| 2010/0294514 | A1 * | 11/2010 | Crow et al. | 166/386 |
| 2010/0294515 | A1 * | 11/2010 | Xu | 166/386 |
| 2011/0067888 | A1 * | 3/2011 | Mireles | 166/386 |
| 2011/0278017 | A1 | 11/2011 | Themig et al. | |
| 2012/0048556 | A1 | 3/2012 | O'Connell et al. | |

FOREIGN PATENT DOCUMENTS

| | | | |
|---|---|---|---|
| RU | SU 1656116 | A1 | 6/1991 |
| RU | 58601 | U1 | 11/2006 |
| RU | 2316643 | C2 | 2/2008 |
| WO | 02/068793 | | 9/2002 |
| WO | 2004009955 | | 1/2004 |
| WO | 2008099166 | | 8/2008 |
| WO | 2010/127457 | A1 | 11/2010 |
| WO | 2011/117601 | A2 | 9/2011 |
| WO | 2011/117602 | A2 | 9/2011 |

OTHER PUBLICATIONS

Examiner's First Report in counterpart Australian Appl. No. 2011201418, dated Feb. 22, 2012.

Examiner's First Report in counterpart Australian Appl. No. 2012200380, dated Feb. 22, 2012.

"Delta Stim Sleeve—Designed for Selective Multi-Zone Fracturing or Acidizing Through the Completion," Halliburton (c) 2008.

"SuperFill Diverter," Halliburton (c) 2007.

"Delta Stim Lite Sleeve—Designed for Selective Multi-Zone Fracturing or Acidizing Through the Completion," Halliburton (c) 2009.

"Frac Sleeve," Magnum Oil Tools International, www.magnumoiltools.com.

"PBL—Multiple Activation Autolock Bypass Systems," Drilling Systems International, www.dsi-pbl.com.

"Autolock Bypass System—Technical Info," Drilling Systems International, obtained from http://www.dsi-pbl.com/products/pbl_autolock.php, generated on Oct. 28, 2009.

"Autolock Bypass System—Application," Drilling Systems International, obtained from http://www.dsi-pbl.com/products/pbl_autolock_app.php, generated on Oct. 28, 2009.

"Electro Mechanical—RFID Operated Fall Through Flapper," Petrowell Ltd. (c) 2008 www.petrowell.co.uk.

"Electro Mechanical—RFID Operated FRAC Sleeve," Petrowell Ltd. (c) 2009 www.petrowell.co.uk.

"Downhole Control Valves—WXO and WXA Standard Sliding Sleeves," Weatherford International, Ltd. (c) 2007-2008.

First Office Action in counterpart Canadian Appl. No. 2,735,402, dated Jul. 31, 2012.

First Office Action in U.S. Appl. No. 13/022,504, mailed Apr. 27, 2012.

Response to First Office Action in U.S. Appl. No. 13/022,504, mailed Apr. 27, 2012.

Second Examination Report in counterpart Australian Appl. No. 2012200380, dated Feb. 5, 2013.

Decision on Grant in Russian Appl. No. 2012103975 counterpart to U.S. Appl. No. 13/022,504, dated May 13, 2013.

Requisition in counterpart Canadian Appl. No. 2,735,402, dated May 24, 2013.

* cited by examiner 100
112
140
148
149
170
120
121
172
120
118
138
116a
136
116b
130
110
132
134

110
148
140
D
127

110
149
148
140
d 100
112
140
148
149
170'
141
121
127
120
118
138
116a
136
116b
130
110
132
134

INDEXING SLEEVE FOR SINGLE-TRIP, MULTI-STAGE FRACING

BACKGROUND

During frac operations, operators want to minimize the number of trips they need to run in a well while still being able to optimize the placement of stimulation treatments and the use of rig/frac equipment. Therefore, operators prefer to use a single-trip, multistage fracing system to selectively stimulate multiple stages, intervals, or zones of a well. Typically, this type of fracing systems has a series of open hole packers along a tubing string to isolate zones in the well. Interspersed between these packers, the system has frac sleeves along the tubing string. These sleeves are initially closed, but they can be opened to stimulate the various intervals in the well.

For example, the system is run in the well, and a setting ball is deployed to shift a wellbore isolation valve to positively seal off the tubing string. Operators then sequentially set the packers. Once all the packers are set, the wellbore isolation valve acts as a positive barrier to formation pressure.

Operators rig up fracing surface equipment and apply pressure to open a pressure sleeve on the end of the tubing string so the first zone is treated. At this point, operators then treat successive zones by dropping successively increasing sized balls sizes down the tubing string. Each ball opens a corresponding sleeve so fracture treatment can be accurately applied in each zone.

As is typical, the dropped balls engage respective seat sizes in the frac sleeves and create barriers to the zones below. Applied differential tubing pressure then shifts the sleeve open so that the treatment fluid can stimulate the adjacent zone. Some ball-actuated frac sleeves can be mechanically shifted back into the closed position. This gives the ability to isolate problematic sections where water influx or other unwanted egress can take place.

Because the zones are treated in stages, the smallest ball and ball seat are used for the lowermost sleeve, and successively higher sleeves have larger seats for larger balls. However, practical limitations restrict the number of balls that can be run in a single well. Because the balls must be sized to pass through the upper seats and only locate in the desired location, the balls must have enough difference in their size to pass through the upper seats.

To overcome difficulties with using different sized balls, some operators have used selective darts that use onboard intelligence to determine when the desired seat has been reached as the dart deploys downhole. An example of this is disclosed in U.S. Pat. No. 7,387,165. In other implementations, operators have used smart sleeves to control opening of the sleeves. An example of this is disclosed in U.S. Pat. No. 6,041,857. Even though such systems may be effective, operators are continually striving for new and useful ways to selectively open sliding sleeves downhole for frac operations or the like.

The subject matter of the present disclosure is directed to overcoming, or at least reducing the effects of, one or more of the problems set forth above.

SUMMARY

Downhole flow tools or sliding sleeves deploy on a tubing string down a wellbore for a frac operation or the like. In one arrangement, the sliding sleeves have first and second inserts that can move in the sleeve's bore. The first insert moves by fluid pressure from a first port in the sleeve's housing. In one arrangement, the first insert defines a chamber with the sleeve's housing, and the first port communicates with this chamber. When the first port in the sleeve's housing is opened, fluid pressure from the annulus enters this open first port and fills the chamber. In turn, the first insert moves away from the second insert by the piston action of the fluid pressure.

The second insert has a catch that can be used to move the second insert. Initially, this catch is inactive when the first insert is positioned toward the second insert. Once the first insert moves away due to filing of the chamber, however, the catch becomes active and can engage a plug deployed down the tubing string to the catch.

In one example, the catch is a profile defined around the inner passage of the second insert. The first insert initially conceals this profile until moved away by pressure in the chamber. Once the profile is exposed, biased dogs or keys on a dropped plug can engage the profile. Then, as the plug seals in the inner passage of the second insert, fluid pressure pumped down the tubing string to the seated plug forces the second insert to an open condition. At this point, additional ports in the sleeve's housing permit fluid communication between the sleeve's bore and the surrounding annulus. In this way, frac fluid pumped down to the sleeve can stimulate an isolated interval of the wellbore formation.

A reverse arrangement for the catch can also be used. In this case, the second insert has dogs or keys that are held in a retracted condition when the first insert is positioned toward the second insert. Once the first insert moves away, the dogs or keys extend outward into the interior passage of the second insert. When a plug is then deployed down the tubing string, it will engage these extended keys or dogs, allowing the second insert to be forced open by applied fluid pressure.

Regardless of the form of catch used, the sliding sleeves have a controller for activating when the first insert moves away from the second insert so the next dropped plug can be caught. The controller has a sensor, such as a hall effect sensor, that detects passage of a magnetic element on the plugs passing through the sliding sleeve.

In one arrangement, control circuitry of the controller uses a counter to count how many plugs have passed through the closed sleeve. Once the count reaches a preset number, the control circuitry activates a valve disposed on the sleeve. This valve can be a solenoid valve or other mechanism and can have a plunger or other form of closure for controlling communication through the housing's chamber port.

When the valve opens the port, fluid pressure from the surrounding annulus fills the chamber between the first insert and the sleeve's housing. This causes the first insert to move in the sleeve and away from the second insert so the catch can be activated. The sliding sleeve is now set to catch the next dropped ball so the sleeve can be opened and fluid can be diverted to the adjacent interval.

In another arrangement, control circuitry of the controller uses a timer in addition to or instead of the counter. The timer is set for a particular time interval. The timer can be activated when one or some preset number of plugs have passed through the sleeve. In any event, once the timer reaches its present time interval, the control circuitry activates the valve disposed on the sleeve as before so fluid in the surrounding annulus can fill the chamber and move the first insert away from the catch of the second insert.

When a timer is used, the sliding sleeve can be beneficially used in conjunction with sleeves having conventional seats. When a first plug is passed through one or more sliding sleeves and lands on the conventional seat of a sleeve, the first plug can activate the timers of the one or more other sliding sleeves up hole on the tubing string. These timers can be set to go off in successive sequence up the tubing string. In this way, once the timer on one of these sleeves activates the sleeve's catch. A second plug having the same size as the first can be deployed to this activated sleeve so a new interval can be treated. Therefore, multiple intervals of a formation can be treated sequentially up the tubing string uses plugs having the same size.

The foregoing summary is not intended to summarize each potential embodiment or every aspect of the present disclosure.

DETAILED DESCRIPTION

Figure 1:
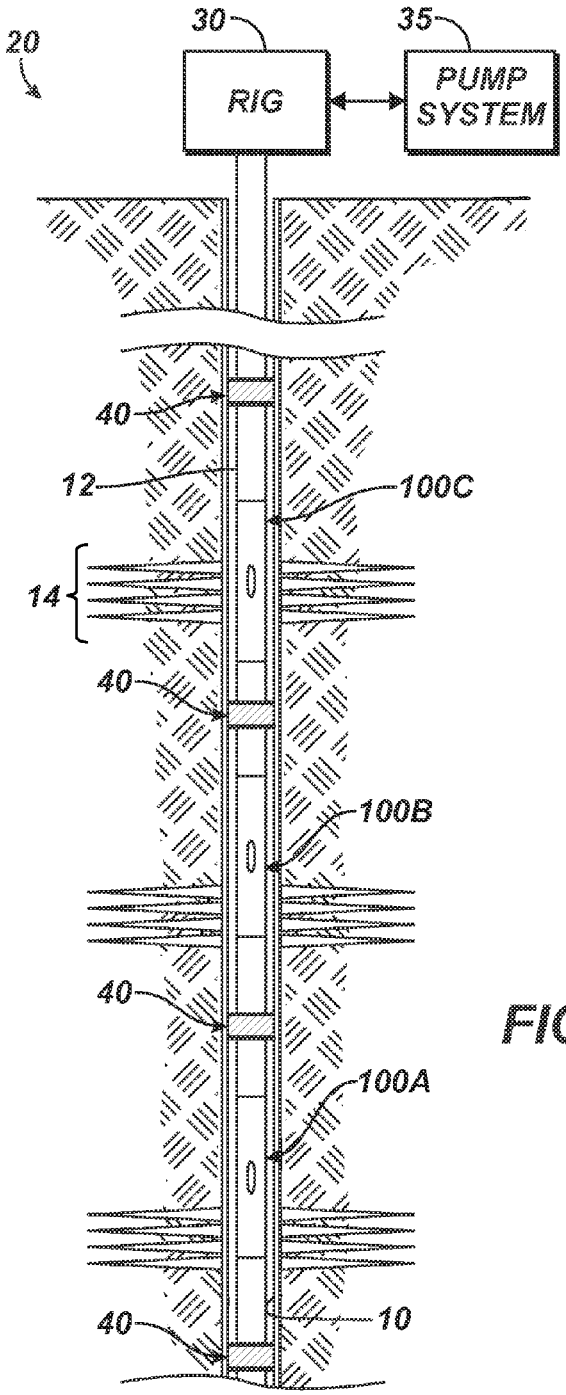
FIG. 1 illustrates a tubing string having indexing sleeves according to the present disclosure.

A tubing string 12 for a wellbore fluid treatment system 20 shown in FIG. 1 deploys in a wellbore 10 from a rig 30 having a pumping system 35. The string 12 has flow tools or indexing sleeves 100A-C disposed along its length. Various packers isolate portions of the wellbore 10 into isolated zones. In general, the wellbore 10 can be an opened or cased hole, and the packers 40 can be any suitable type of packer intended to isolate portions of the wellbore into isolated zones.

The indexing sleeves 100A-C deploy on the tubing string 12 between the packers 40 and can be used to divert treatment fluid selectively to the isolated zones of the surrounding formation. The tubing string 12 can be part of a frac assembly, for example, having a top liner packer (not shown), a wellbore isolation valve (not shown), and other packers and sleeves (not shown) in addition to those shown. If the wellbore has casing, then the wellbore 10 can have casing perforations 14 at various points.

As conventionally done, operators deploy a setting ball to close the wellbore isolation valve (not shown). Then, operators rig up fracing surface equipment and pump fluid down the wellbore to open a pressure actuated sleeve (not shown) toward the end of the tubing string 12. This treats a first zone of the formation. Then, in a later stage of the operation, operators selectively actuate the indexing sleeves 100A-C between the packers 40 to treat the isolated zones depicted in FIG. 1.

The indexing sleeves 100A-C have activatable catches (not shown) according to the present disclosure. Based on a specific number of plugs (i.e., darts, balls or other the like) dropped down the tubing string 12, internal components of a given indexing sleeve 100A-C activate and engage the dropped plug. In this way, one sized plug can be dropped down the tubing string 12 to open the indexing sleeve 100A-C selectively.

With a general understanding of how the indexing sleeves 100A-C are used, attention now turns to details of an indexing sleeve 100 shown in FIGS. 2A-2C and FIGS. 3A-3F.

Figure 2A:
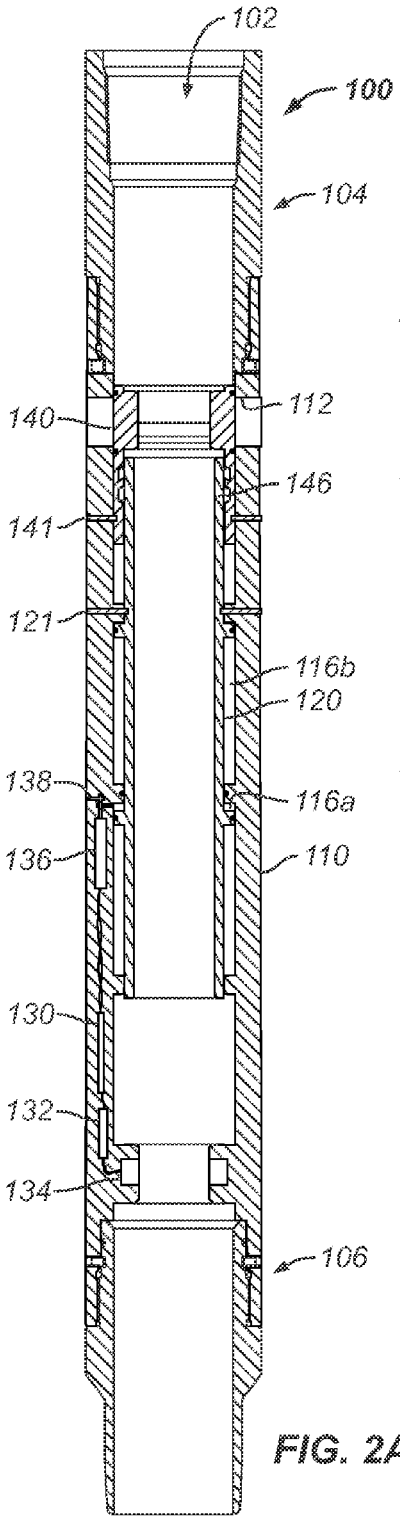
FIGS. 2A-2B illustrate an indexing sleeve according to the present disclosure in a closed condition.
Figure 2B:
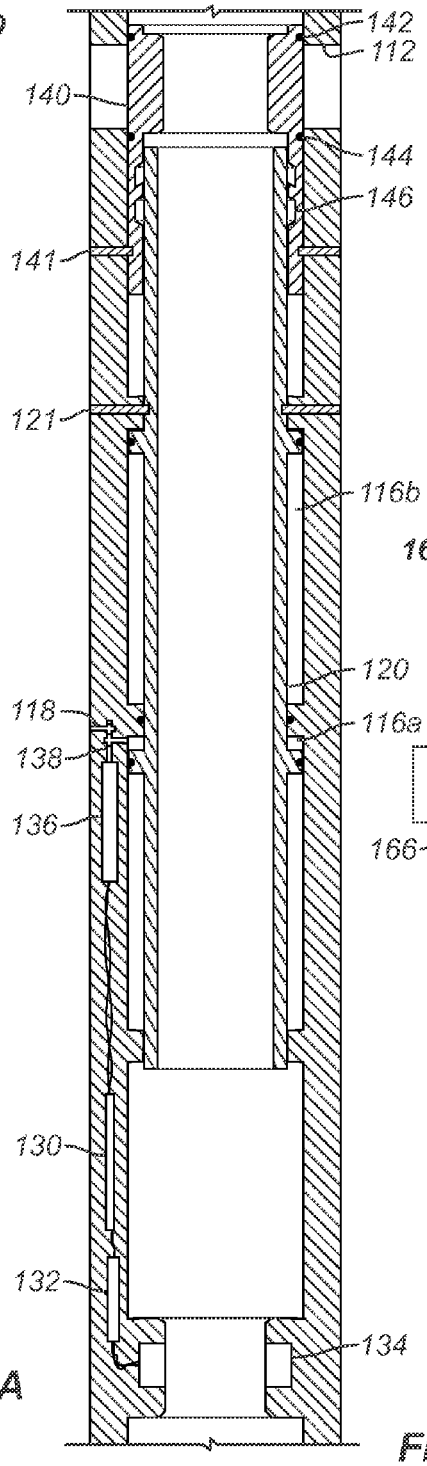

As best shown in FIG. 2A, the indexing sleeve 100 has a housing 110 defining a bore 102 therethrough and having ends 104/106 for coupling to a tubing string (not shown). Inside, the housing 110 has two inserts (i.e., insert 120 and sleeve 140) disposed in its bore 102. The insert 120 can move from a closed position (FIG. 2A) to an open position (FIG. 3C) when an appropriate plug (e.g., dart 150 of FIG. 2D or other form of plug) is passed through the indexing sleeve 100 as discussed in more detail below. Likewise, the sleeve 140 can move from a closed position (FIG. 2A) to an opened position (FIG. 3D) when another appropriate plug (e.g. dart 150 or other form of plug) is passed later through the indexing sleeve 100 as also discussed in more detail below.

The indexing sleeve 100 is run in the hole in a closed condition. As shown in FIG. 2A, the insert 120 covers a portion of the sleeve 140. In turn, the sleeve 140 covers external ports 112 in the housing 110, and peripheral seals 142/144 on the sleeve 140 prevent fluid communication between the bore 102 and these ports 112. When the insert 120 has the open condition (FIG. 3C), the insert 120 is moved away from the sleeve 140 so that a profile 146 on the sleeve 140 is exposed in the housing's bore 102. Finally, the sleeve 140 in the open position (FIG. 3D) is moved away from the ports 112 so that fluid in the bore 102 can pass out through the ports 112 to the surrounding annulus and treat the adjacent formation.

Figure 3A:
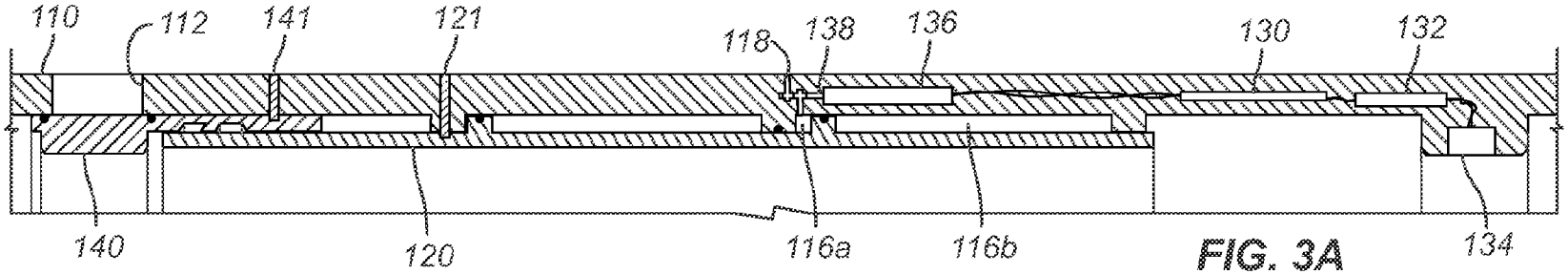
FIGS. 3A-3F show the indexing sleeve in various stages of operation.

Initially, control circuitry 130 in the indexing sleeve 100 is programmed to allow a set number of frac darts 150 to pass through the indexing sleeve 100 before activation. Then, the indexing sleeve 100 runs downhole in the closed condition as shown in FIGS. 2A and 3A. To then begin a frac operation, operators drop a frac dart 150 down the tubing string from the surface.

Figure 2D:
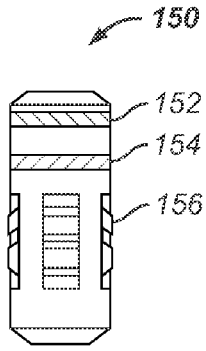
FIG. 2D shows a frac dart for use with the indexing sleeve of FIG. 2A.

As shown in FIG. 2D, the dart 150 has an external seal 152 disposed thereabout for engaging in the sleeve (140). The dart 150 also has retractable X-type keys 156 (or other type of dog or key) that can retract and extend from the dart 150. Finally, the dart 150 has a sensing element 154. In one arrangement, this sensing element 154 is a magnetic strip or element disposed internally or externally on the dart 150.

Figure 3B:
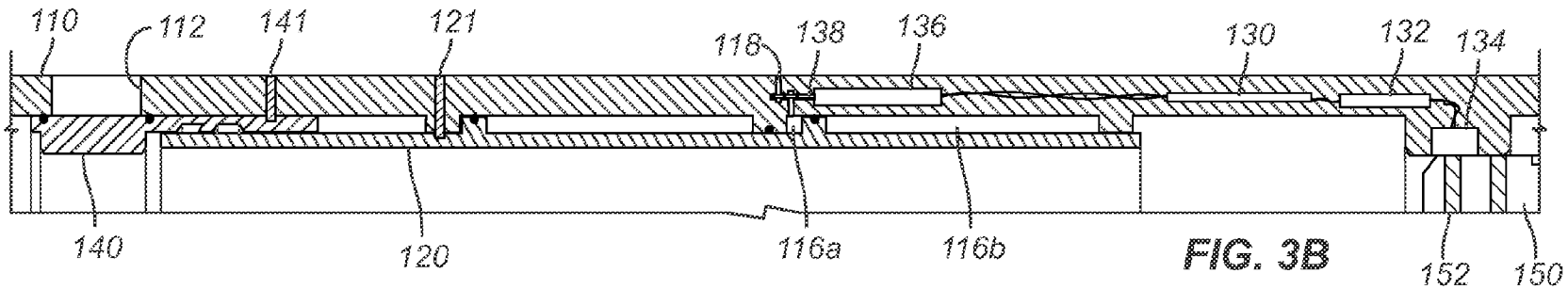

Once the dart 150 is dropped down the tubing string, the dart 150 eventually reaches the indexing sleeve 100 as shown in FIG. 3B. Because the insert 120 covers the profile 146 in the sleeve 140, the dropped dart 150 cannot land in the sleeve's profile 146 and instead continues through most of the indexing sleeve 100. Eventually, the sensing element 154 of the dart 150 meets up with a sensor 134 disposed in the housing's bore 102.

Connected to a power source (e.g., battery) 132, this sensor 134 communicates an electronic signal to control circuitry 130 in response to the passing sensing element 154. The control circuitry 130 can be on a circuit board housed in the indexing sleeve 100 or elsewhere. The signal indicates when the dart's sensing element 154 has met the sensor 134. For its part, the sensor 134 can be a hall effect sensor or any other sensor triggered by magnetic interaction. Alternatively, the sensor 134 can be some other type of electronic device. Also, the sensor 134 could be some form of mechanical or electromechanical switch, although an electronic sensor is preferred.

Using the sensor's signal, the control circuitry 130 counts, detects, or reads the passage of the sensing element 154 on the dart 150, which continues down the tubing string (not shown). The process of dropping a dart 150 and counting its passage with the sensor 134 is then repeated for as many darts 150 the sleeve 100 is set to pass. Once the number of passing darts 150 is one less than the number set to open this indexing sleeve 100, the control circuitry 130 activates a valve 136 on the sleeve 100 when this second to last dart 150 has passed and generated a sensor signal. Once activated, the valve 136 moves a plunger 138 that opens a port 118. This communicates a first sealed chamber 116*a* between the insert 120 and the housing 110 with the surrounding annulus, which is at higher pressure.

Figure 2C:
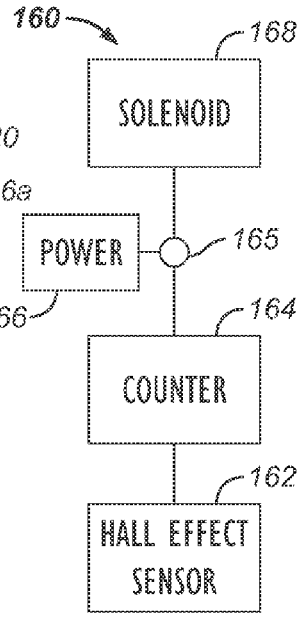
FIG. 2C diagrams a controller for the indexing sleeve of FIG. 2A.

FIG. 2C shows an example of a controller 160 for the disclosed indexing sleeve 100. A hall effect sensor 162 responds to the magnetic strip (152) of the dart (150), and a counter 164 counts the passage of the dart's strip (152). When a present count has been reached, the counter 164 activates a switch 165, and a power source 166 activates a solenoid valve 168, which moves a plunger (138) to open the port (118). Although a solenoid valve 168 can be used, any other mechanism or device capable of maintaining a port closed with a closure until activated can be used. Such a device can be electronically or mechanically activated. For example, a spring-biased plunger could be used to close off the port. A filament or other breakable component can hold this biased plunger in a closed state to close off the port. When activated, an electric current, heat, force or the like can break the filament or other component, allowing the plunger to open communication through the port. These and other types of valve mechanisms could be used.

Figure 3C:
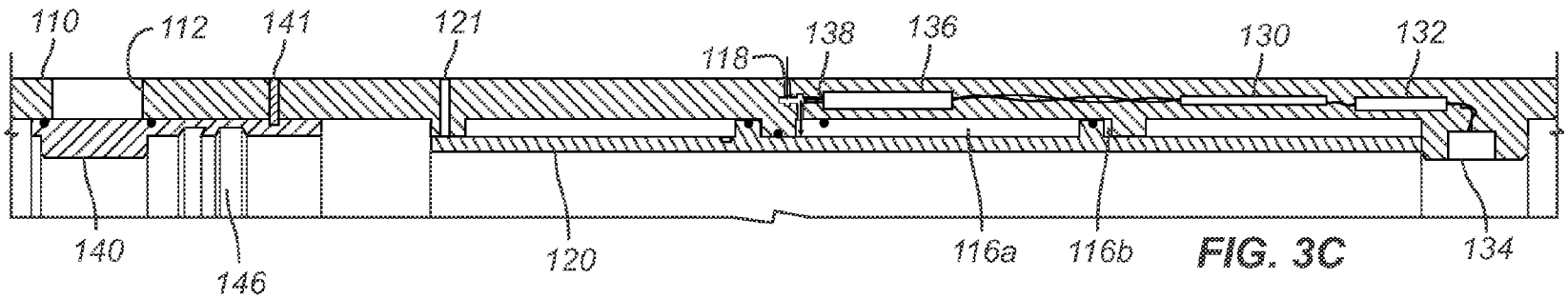

Once the port 118 is opened as shown in FIG. 3C, surrounding fluid pressure from the annulus passes through the port 118 and fills the chamber 116*a*. An adjoining chamber 116*b* provided between the insert 120 and the housing 110 can be filled to atmospheric pressure. This chamber 116*b* can be readily compressed when the much higher fluid pressure from the annulus (at 5000 psi or the like) enters the first chamber 116*a*.

In response to the filling chamber 116*a*, the insert 120 shears free of shear pins 121 to the housing 110. Now freed, the insert 120 moves (downward) in the housing's bore 102 by the piston effect of the filling chamber 116*a*. Once the insert 120 has completed its travel, its distal end exposes the profile 146 inside the sleeve 140 as also shown in FIG. 3C.

Figure 3D:
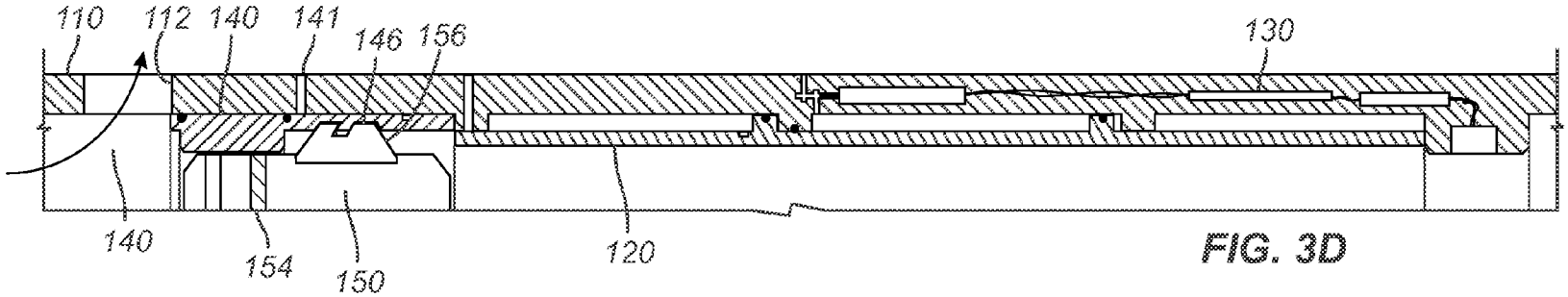

To now open this particular indexing sleeve 100, operators drop the next frac dart 150. As shown in FIG. 3D, this dart 150 reaches the exposed profile 146 on the sleeve 140. The biased keys 156 on the dart 150 extend outward and engage or catch the profile 146. The key 156 has a notch locking in the profile 146 in only a first direction tending to open the second insert. The rest of the key 156, however, allows the dart 150 move in a second direction opposite to the first direction so it can be produced to the surface as discussed later.

The dart's seal 152 seals inside an interior passage or seat in the sleeve 140. Because the dart 150 is passing through the sleeve 140, interaction of the seal 152 with the surrounding sleeve 140 can tend to slow the dart's passage. This helps the keys 156 to catch in the exposed profile 146.

Operators apply frac pressure down the tubing string 120, and the applied pressure shears the shear pins 141 holding the sleeve 140 in the housing 110. Now freed, the applied pressure moves the sleeve 140 (downward) in the housing to expose the ports 112, as shown in FIG. 3D. At this point, the frac operation can stimulated the adjacent zone of the formation.

Figure 3E:
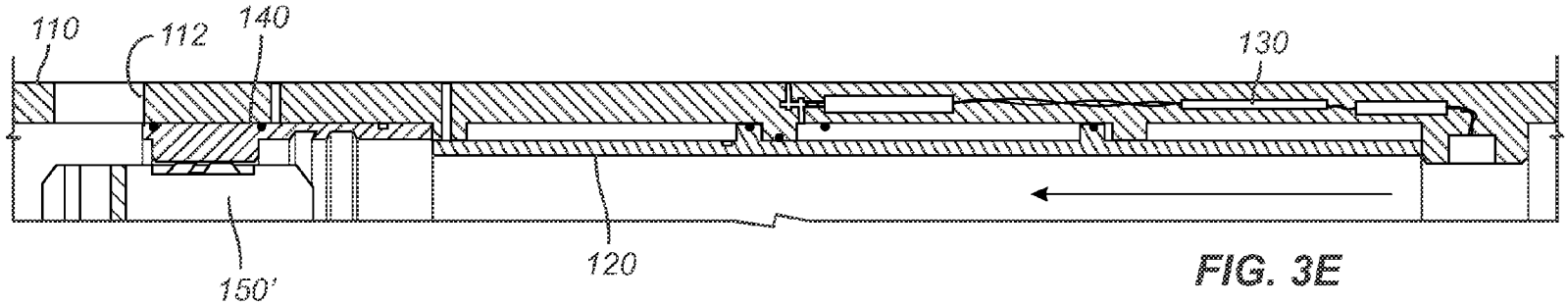
Figure 3F:
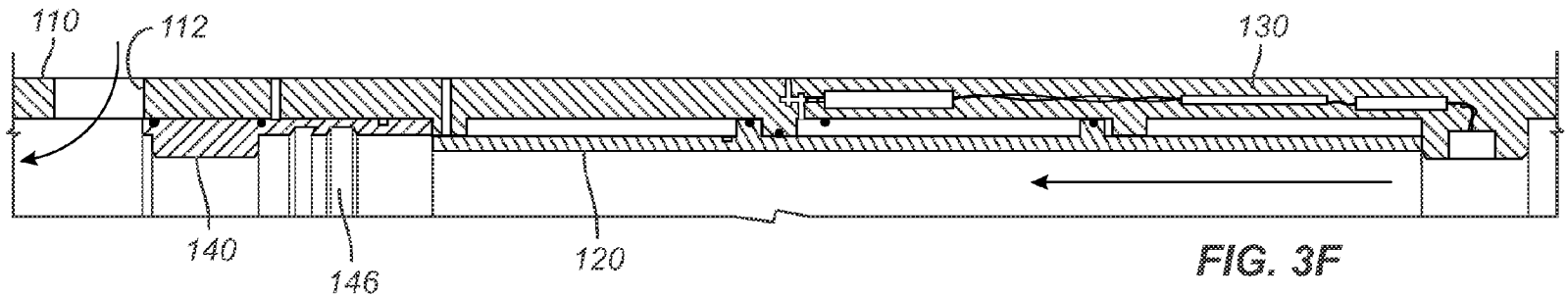

After all of the zones having been stimulated, operators open the well to production by opening any downhole control valve or the like. Because the darts 150 have a particular specific gravity (e.g., about 1.4 or so), production fluid communing up the tubing and housing bore 102 as shown in FIG. 3E brings the dart 150 back to the surface. If for any reason, one or more of the darts 150 do not come to the surface, then these remaining darts 150 can be milled. Finally, as shown in FIG. 3F, the well can be produced through the open sleeve 100 without restriction or intervention. At any point, the indexing sleeve can be manually reset closed by using an appropriate tool.

Figures 4A, 4B, 4C:
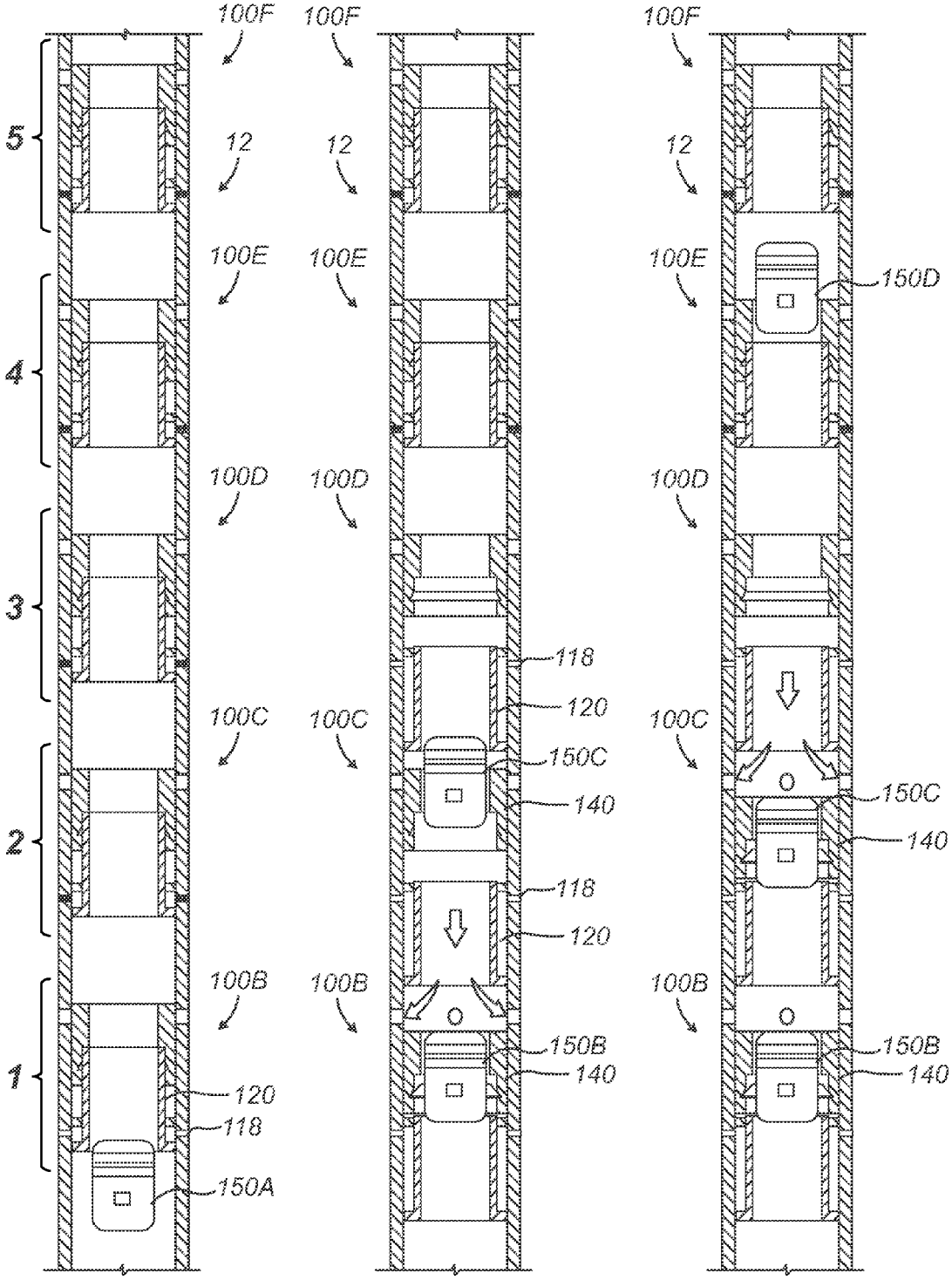
FIGS. 4A-4C schematically illustrate an arrangement of indexing sleeves in various stages of operation.

To help show how particular indexing sleeves 100 can be selectively opened, FIGS. 4A-4C show an arrangement of indexing sleeves 100B-F in various stages of operation. As shown in FIG. 4A, a first dart 150A has been dropped down the tubing string 12, and it has passed through each of the indexing sleeves 100B-F, increasing their counts. The lowermost indexing sleeve 100B being set to one count activates so that its insert 120 moves by fluid pressure entering from side port 118.

When the next dart 150B is dropped as shown in FIG. 4B, it passes through each sleeve 100C-F and engages in the exposed profile 146 of the lowermost sleeve 100B. After the dart 150 passes the second-to-last indexing sleeve 100C, its insert 120 activates and moves to expose its sleeve 140's profile. Eventually, the dart 150B seats in the lowermost sleeve 100B. Frac fluid pumped down the tubing string 12 can then exit the sleeve 100B and stimulate the surrounding interval.

After facing, the next dart 150C drops down the tubing sting and adds to the count of each sleeve 100D-F. Eventually, this dart 150C activates the third sleeve 100D when passing as shown in FIG. 4B. Finally, this dart 150C lands in the second sleeve 100C as shown in FIG. 4C so that fracing can be performed and the next dart 150D dropped. This operation continues up the tubing string 12. Each deployed dart 150 can have the same diameter, and each indexing sleeve 100 can be set to ever-increasing counts of passing darts 150.

Figure 5A:
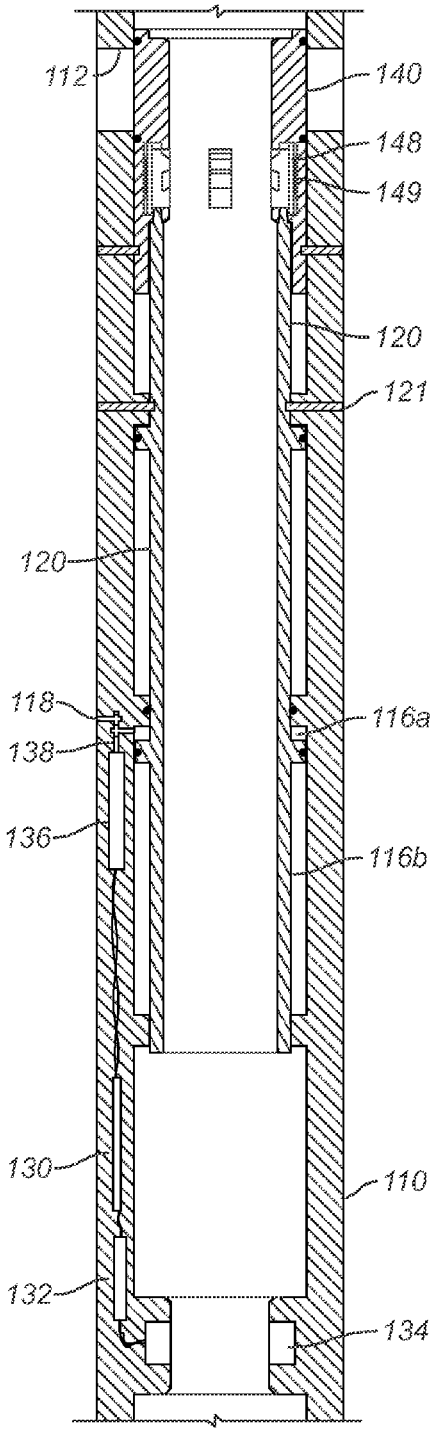
FIG. 5A illustrates another indexing sleeve according to the present disclosure in a closed condition.

The previous indexing sleeve 100 of FIG. 2A uses a profile 146 on its sleeve 140, while the dart 150 of FIG. 2D uses biased keys 156 to catch on the profile 146 when exposed. A reverse arrangement can be used. As shown in FIG. 5A, an indexing sleeve 100 has many of the same components as the previous embodiment so that like reference numerals are used. The sleeve 140, however, has a plurality of keys or dogs 148 disposed in surrounding slots in the sleeve 140. Springs or other biasing members 149 bias these dogs 148 through these slots toward the interior of the sleeve 140 where a frac plug passes.

Initially, these keys 148 remain retracted in the sleeve 140 so that frac darts 150 can pass as desired. However, once the insert 120 has been activated by one of the darts 150 and has moved (downward) in the sleeve 100, the insert's proximal end 125 disengages from the keys 148. This allows the springs 149 to bias the keys 148 outward into the bore 102 of the sleeve 100. At this point, the next dart 150 will engage the keys 148.

Figure 5C:
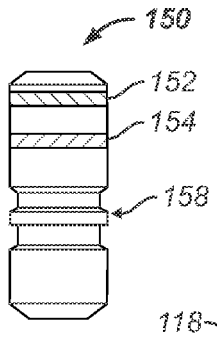
FIG. 5C shows a frac dart for use with the sleeve of FIG. 5A.
Figure 5B:
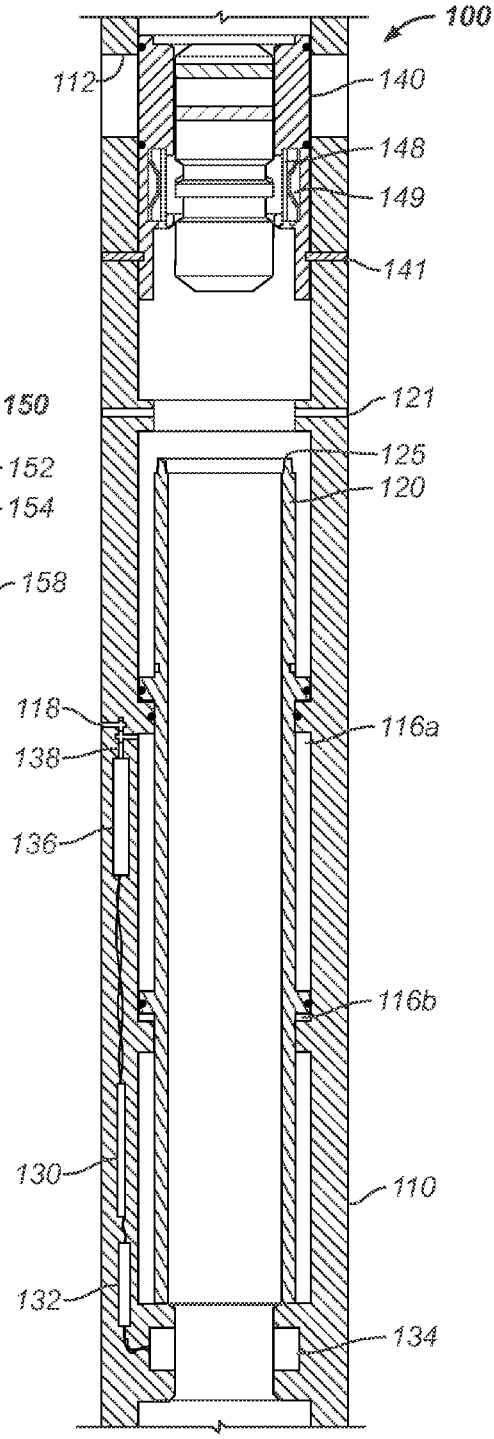
FIG. 5B shows the indexing sleeve of FIG. 5A during opening.

For example, FIG. 5C shows a dart 150 having a magnetic strip 154, seal 152, and profile 158. As shown in FIG. 5B, the dart 150 meets up to the sleeve 140, and the extended keys 148 catch in the dart's exposed profile 158. At this stage, fluid pressure applied against the caught dart 150 can move the sleeve 140 (downward) in the indexing sleeve 100 to open the housing's ports 112.

The previous indexing sleeves 100 and darts 150 have keys and profiles. As an alternative, an indexing sleeve 100 shown in FIG. 6A uses a ball 170 having a sensing element 172, such as a magnet. Again, this indexing sleeve 100 has many of the same components as the previous embodiment so that like reference numerals are used. Additionally, the sleeve 140 has a plurality of keys or dogs 148 disposed in surrounding slots in the sleeve 140. Springs or other biasing members 149 bias these dogs 148 through these slots toward the interior of the sleeve 140.

Figures 6A, 6B, 6C, 6D:
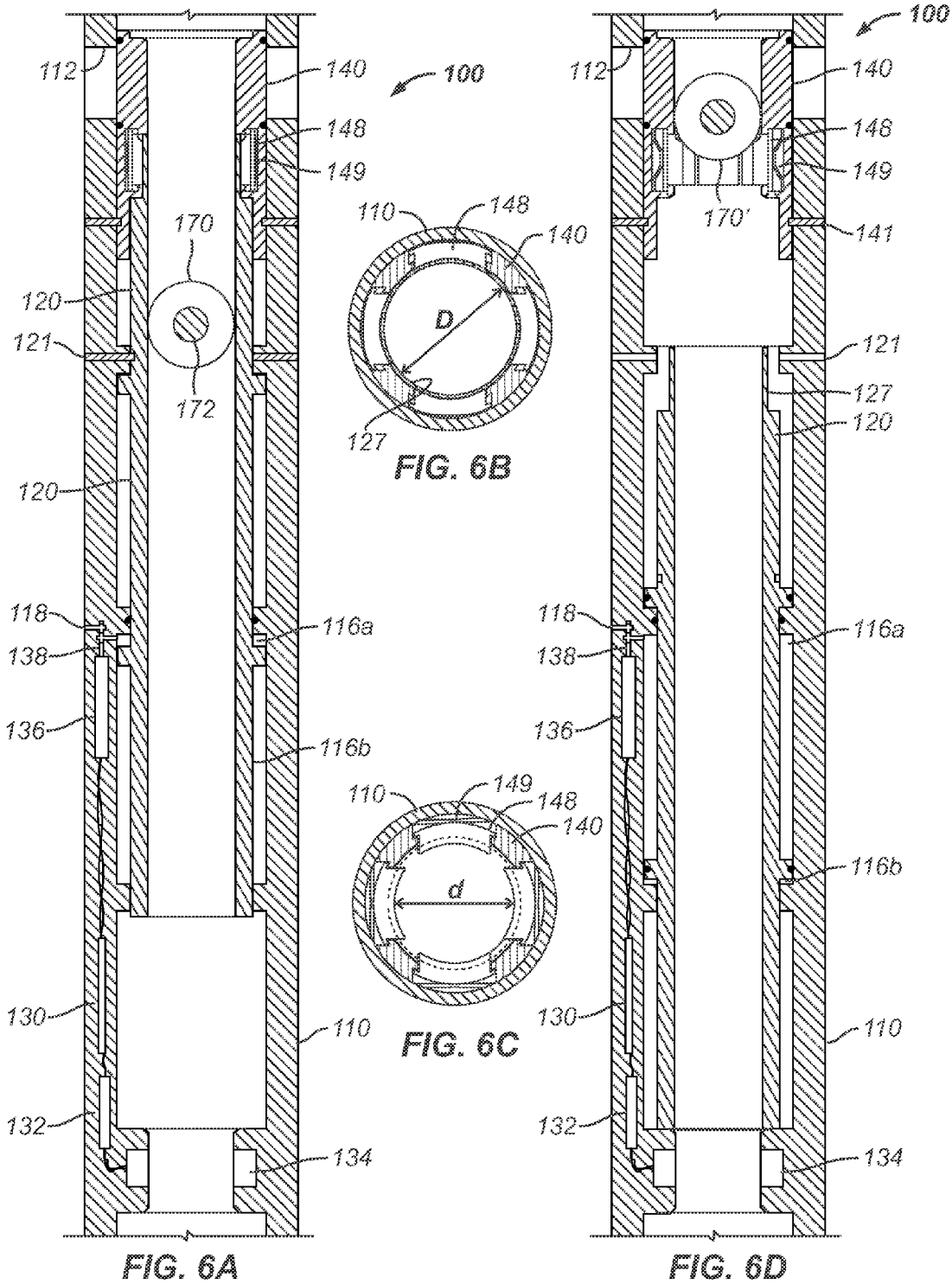
FIG. 6A illustrates yet another indexing sleeve according to the present disclosure in a closed condition.
FIGS. 6B-6C shows lateral cross-sections of the indexing sleeve of FIG. 6A.
FIG. 6D shows the indexing sleeve of FIG. 6A during a stage of closing.

Initially, the keys 148 remain retracted as shown in FIG. 6A. Once the insert 120 has been activated as shown in FIG. 6D, the insert's distal end 127 disengages from the keys 148. Rather than catching internal ledges on the keys 148 as in the previous embodiment, the distal end 127 shown in FIG. 6D initially covers the keys 148 and exposes them once the insert 120 moves.

Either way, the springs 149 bias the keys 148 outward into the bore 102. At this point, the next ball 170' will engage the extended keys 148. For example, the end-section in FIG. 6B shows how the distal end 127 of the insert 120 can hold the keys 148 retracted in the sleeve 140, allowing for passage of balls 170 through the larger diameter D. By contrast, the end-section in FIG. 6C shows how the extend keys 148 create a seat with a restricted diameter d to catch a ball 170.

As shown, four such keys 148 can be used, although any suitable number could be used. As also shown, the proximate ends of the keys 148 can have shoulders to catch inside the sleeve's slots to prevent the keys 148 from passing out of these slots. In general, the keys 148 when extended can be configured to have ⅛-inch interference fit to engage a corresponding plug (e.g., ball 170). However, the tolerance can depend on a number of factors.

When the dropped ball 170' reaches the keys 148 as in FIG. 6D, fluid pressure pumped down through the sleeve's bore 102 forces against the obstructing ball 170. Eventually, the force releases the sleeve 140 from the pin 141 that initially holds it in its closed condition.

Previous indexing sleeves 100 included an insert moved by fluid pressure once a set number of dart or balls have passed through the sleeve 100. The moved insert 120 then reveals a profile or keys on a sleeve 140 that can catch the next plug (e.g., dart 150 or ball 170) dropped through the indexing sleeve 100. As an alternative, an indexing sleeve 100 shown in FIG. 7 lacks the separate insert and sliding sleeve from before. Instead, this sleeve has an integral insert 180. Many of the sleeve's components are the same as before, including the control circuitry 130, battery 132, sensor 134, valve 136, etc. The insert 180 defines the chambers 116*a-b* with the housing 110 and covers the housing's ports 112.

When a set number of plugs (e.g., balls 170) have passed the sensor 134 and been counted, the control circuitry 130 activates the valve 136 so that the plunger 138 opens chamber port 118. Surrounding fluid pressure passes through the chamber port 118 and fills the chamber 116*a* to move the insert 180. As it moves, the insert 180 shears free of shear pins 181 to the housing 110 and reveals the housing's ports 112. Thus, this sleeve 100 opens when a set number of plugs has passed, but the sleeve 100 lacks a seat or the like to catch a dart or ball dropped therein. Accordingly, this sleeve 100 may be useful when two or more sleeves along the tubing string are to be opened by the same passing dart or ball. This may be useful when a long expanse of a formation along a wellbore is to be treated.

Figure 8:
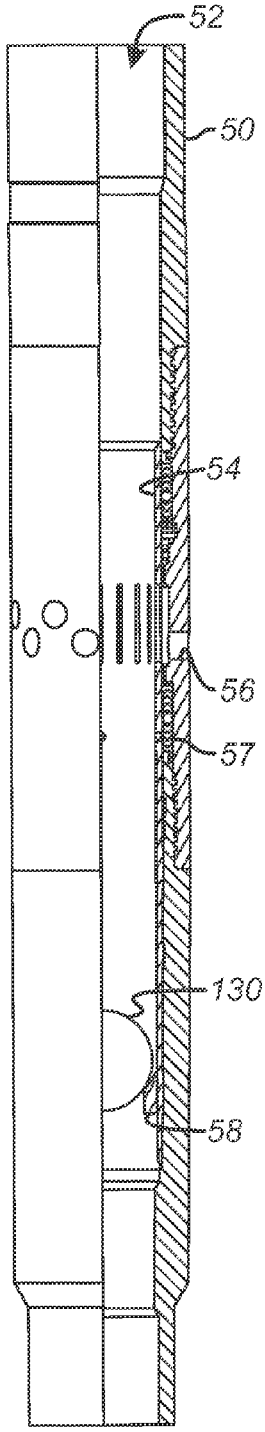
FIG. 8 shows an isolation sleeve according in an opened condition.

As mentioned previously, several indexing sleeves 100 can be used on a tubing string. These indexing sleeves 100 can be used in conjunction with one or more sliding sleeves 50. In FIG. 8, a sliding sleeve 50 is shown in an opened condition. The sliding sleeve 50 defines a bore 52 therethrough, and an insert 54 can be moved from a closed condition to an open condition (as shown). A dropped plug 190 (e.g., dart, ball, or the like) with its specific diameter is intended to land on an appropriately sized ball seat 58 within the insert 54.

Once seated, the plug 190 typically seals in the seat 56 and does not allow fluid pressure to pass further downhole from the sleeve 50. The fluid pressure communicated down the isolation sleeve 50 therefore forces against the seated plug 190 and moves the insert 54 open. As shown, openings in the insert 54 in the open condition communicate with external ports 56 in the isolation sleeve 50 to allow fluid in the sleeve's bore 52 to pass out to the surrounding annulus. Seals 57, such as chevron seals, on the inside of the bore 52 can be used to seal the external ports 56 and the insert 54. One suitable example for the isolation sleeve 50 is the Single-Shot Zone-Select Sleeve available from Weatherford.

The arrangement of sleeves 100 discussed in FIGS. 4A-4C relied on consecutive activation of the indexing sleeves 100 by dropping an ever-increasing number of darts 150 to actuate ever-higher sleeves 100. Given the various embodiments of indexing sleeves 100 disclosed herein and how they can be used in conjunction with sliding sleeves 50, FIGS. 9A-9B show an exemplary arrangement of multiple indexing sleeves 200 and sliding sleeves 50.

Figure 9A:
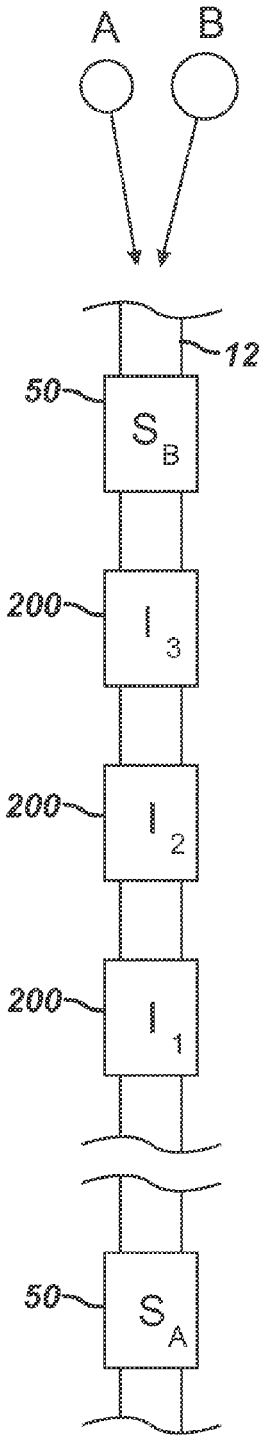
FIGS. 9A-9B schematically illustrate an arrangement of sleeves in various stages of operation.
Figure 9B:
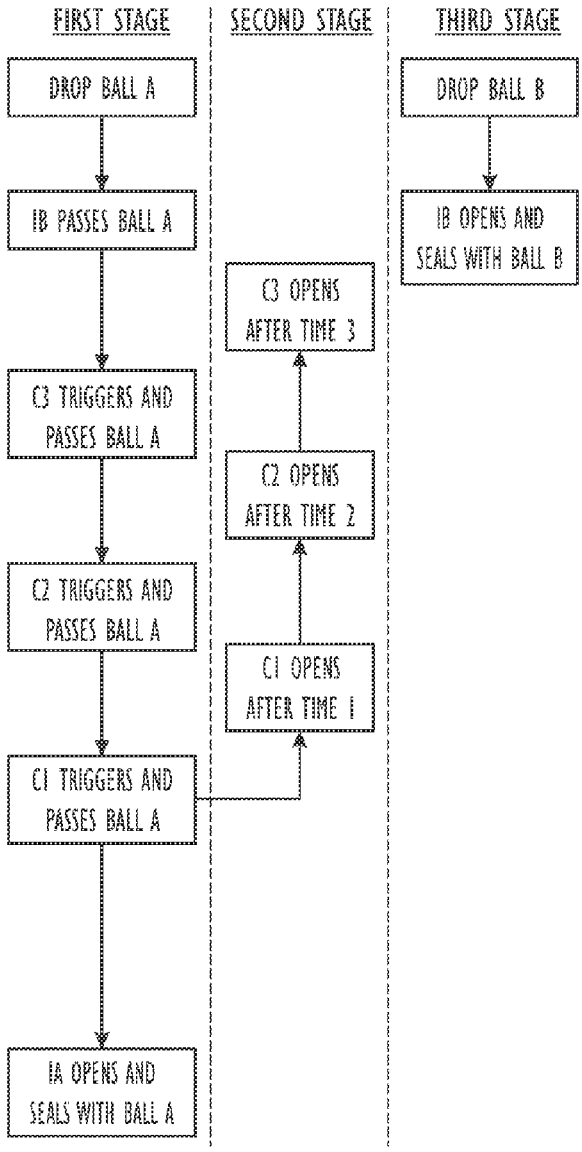

As shown in FIG. 9A, the arrangement of sleeves include a sliding sleeve 50 ($S_A$), a succession of three indexing sleeves 200 ($I_1$-$I_3$), and another sliding sleeve 50 ($S_B$). These sleeves 50/200 can be divided into any number of zones using packers (not shown), and their arrangement as depicted in FIG. 9A is illustrative. Depending on the particular implementation and the treatment desired, any number of sleeves 50/200 can be arranged in any number of zones, and packers or other devices (not shown) can be used to isolate various intervals between any of the sleeves 50/200 from one another.

Dropping of two different sized plugs (A & B) (i.e., dart, balls, or the like) with different sizes are illustrated in different stages for this example. Any number of differently sized plugs, balls, darts, or the like can be used. In addition, the relevant size of the plugs (A & B) pertains to their diameters, which can range from 1-inch to 3¾-inch in some instances.

In the first stage, operators drop the smaller plug (A). As it travels, plug (A) passes through sliding sleeve 50(SB) without engaging its larger seat. The plug (A) also passes through indexing sleeves 100($I_1$-$I_3$) without opening them. Finally, the plug (A) engages the seat in sliding sleeve 50($S_A$). Fluid treatment down the tubing string 12 opens the sliding sleeve 50($S_A$) and stimulates the formation adjacent to it.

After passing through each of the indexing sleeves 200, however, the plug (A) triggers their activation. Rather than counting the number of passing plugs, however, these sleeves 200 use their sensors (e.g., 134) or other mechanism to trigger a timed activation of the sleeves 200. In this case, the controller of the sleeve 200 uses a timer instead of (or in addition to) the counter described previously in FIG. 2D. Each of the indexing sleeves 200 can then be set to activate at successive times.

In second stages, for example, indexing sleeves 200($I_1$-$I_3$) activate at different or same times based on the preset time interval they are set to after passage of the initial sized plug (A). Additionally, depending on the type of disclosed sleeve used, additional plugs (A) of the same size may or may not be dropped to open these sleeves 200.

Figure 7:
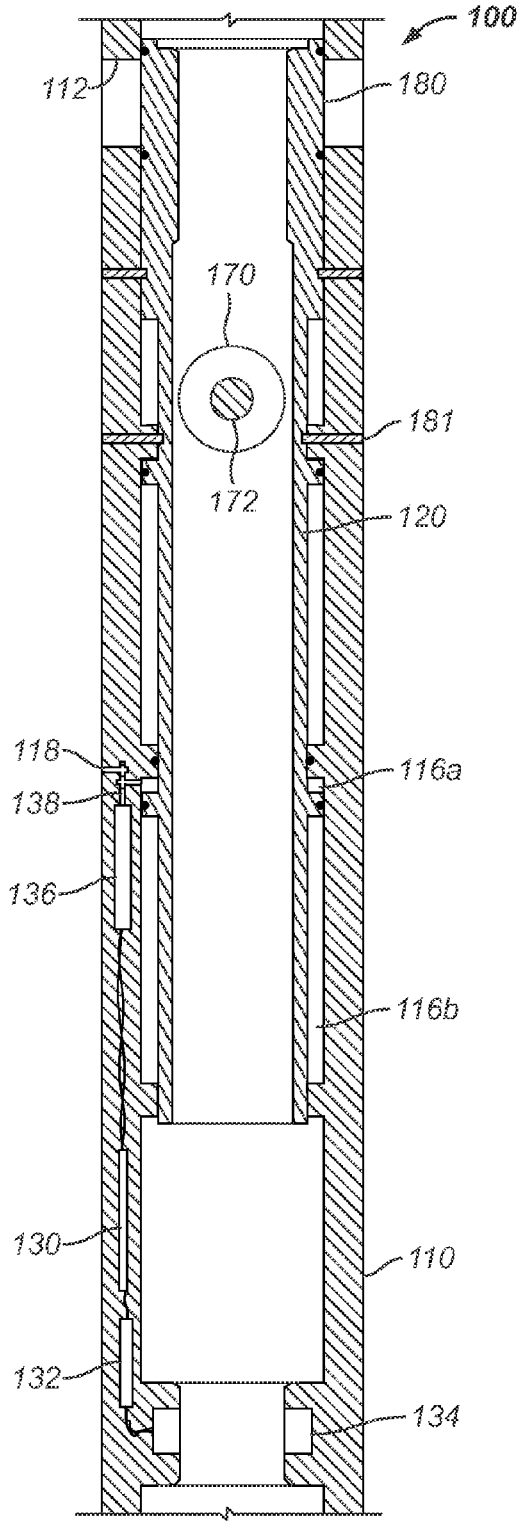
FIG. 7 illustrates yet another indexing sleeve according to the present disclosure in a closed condition.

In one example, any of the sleeves 200($I_1$-$I_3$) can be similar to the sleeve 100 of FIG. 7 so that they open once activated but do not have a seat for engaging a dropped plug (A). In this way, such sleeves could expose more of a formation in the same or different interval for treatment at the same or successive times as the lowermost sliding sleeve 50($S_A$). Then, in a third stage, operators can drop a larger sized plug (B) to land in the other sliding sleeve 50($S_B$) to seal off all of the sleeves 50($S_A$) and 200($I_1$-$I_3$).

In another example, one or more of the sleeves 200($I_1$-$I_3$) can be similar to the sleeves 100 of FIG. 2A, 5A, or 6A. Once triggered, the timer of the control circuitry (130) can activate the valve (136) to fill the piston chamber (116*a*) and move the sleeve's insert (120). This can reveal the profile (146) of the sliding sleeve (140) or can free keys (148) of the sliding sleeve 140 to engage another plug (A) dropped down the tubing string 12.

For example, the indexing sleeve 200($I_1$) can be such a sleeve and can activate at a set time $T_1$ (e.g., a couple of hours or so) after the first dropped plug (A) has passed and landed in the lowermost sliding sleeve 50($S_A$). The set time $T_1$ gives operators time to treat the interval near the sliding sleeve 50($S_A$). Once the sleeve 200($I_1$) activates after time $T_1$, however, operators drop a same sized plug (A) to catch in this indexing sleeve 200($I_1$) so its adjacent formation can be treated.

This process can be repeated up the tubing string 12. Indexing sleeve 200($I_2$) can activate at a later time $T_2$ after the second plug (A) has passed and can catch a third plug (A), and the other sleeve 200($I_3$) can then do the same with another time $T_3$. In this way, operators can treat any number of intervals using the same sized plug (A) before using another sized plug (B) to land in the other sliding sleeve 50($S_B$) in a third stage.

As disclosed herein, the plug (A) can be a ball or dart with a magnetic element or strip to be detected by the sleeves 200. Due to the narrowness of the tubing strings bore and the size limitations for plugs, conventional approaches allow operators to treat only a limited number of intervals using an array of ever-increasing sized plugs and sleeve seats. The number of sizes may be limited to about 20. Being able to insert one or more of the indexing sleeves 200 between conventionally seating sliding sleeves 50, however, operators can greatly expand the number of intervals that they can treat with the limited number of sized plugs and sleeve seats.

The foregoing description of preferred and other embodiments is not intended to limit or restrict the scope or applicability of the inventive concepts conceived of by the Applicants. As described above, a plug can be a dart, a ball, or any other comparable item for dropping down a tubing string and landing in a sliding sleeve. Accordingly, plug, dart, ball, or other such term can be used interchangeably herein when referring to such items. As described above, the various indexing sleeves disclosed herein can be arranged with one another and with other sliding sleeves. It is possible, therefore, one type of indexing sleeve and plug to be incorporated into a tubing string having another type of indexing sleeve and plug disclosed herein. These and other combinations and arrangements can be used in accordance with the present disclosure.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole flow tool, comprising:

a housing having a bore and defining first and second ports communicating the bore outside the housing;

a first insert disposed in the bore and movable from a first position to a second position in response to fluid pressure from the first port;

a second insert movably disposed in the bore relative to the second port, the second insert having a catch for moving the second insert, the catch disposed in an interior passage of the second insert, the catch having an inactive condition engaged by a portion of the first insert when the first insert has the first position, the catch having a default active condition disengaged by the portion of the first insert and exposed in the bore when the first insert moves toward the second position, the second insert movable from a closed condition restricting fluid communication through the second port to an opened condition permitting fluid communication through the second port; and a controller opening fluid communication through the first port in response to a predetermined signal.

2. The tool of claim 1, wherein the controller comprises a sensor responsive to passage of a sensing element relative thereto.

3. The tool of claim 2, wherein the sensor comprises a hall effect sensor responsive to magnetic material of the sensing element.

4. The tool of claim 2, wherein the controller comprises:

a counter counting one or more responses of the sensor and comparing the one or more responses to a predetermined count; and a valve activated by the controller when the one or more responses at least meet the predetermined count and opening fluid communication through the first port.

5. The tool of claim 2, wherein the controller comprises:

a timer activating a predetermined time interval in response to a response by the sensor; and a valve activated by the controller in response to passage of the predetermined time interval and opening fluid communication through the first port.

6. The tool of claim 1, wherein the controller comprises a solenoid valve having a plunger movable relative to the first port.

7. The tool of claim 1, wherein the catch comprises a profile defined in the interior passage of the second insert, the profile in the inactive condition being covered by the portion of the first insert in the first position, the profile in the active condition being exposed.

8. The tool of claim 7, further comprising a plug having at least one biased key disposed thereon, the at least one biased key engaging the profile in the active condition.

9. The tool of claim 1, wherein the catch comprises at least one key disposed thereon and biased toward the interior passage of the second insert, the at least one key in the inactive condition being retracted from the interior passage by the portion of the first insert in the first position, the at least one key in the active condition being extended into the interior passage.

10. The tool of claim 9, further comprising a plug engaging the at least one key in the active condition.

11. The tool of claim 10, wherein the plug comprises a profile engaging the at least one key.

12. The tool of claim 1, wherein the second insert moves from the closed condition to the opened condition in response to fluid pressure activating against a plug engaged by the catch in the second insert.

13. The tool of claim 1, further comprising a plug deployable through the bore of the housing and through the interior passage in the second insert, the plug having a sensing element initiating the predetermined signal of the controller when deployed in proximity thereto.

14. The tool of claim 13, wherein the plug comprises at least one key biased thereon, the at least one key extended to engage the catch and retracted to pass through the bore and the interior passage.

15. The tool of claim 14, wherein the at least one key has one or more notches defined thereon, the one or more notches locking in the catch in only a first direction tending to open the second insert, the one or more notches permitting the plug to move in a second direction opposite to the first direction.

16. The tool of claim 14, wherein the plug comprises a seal disposed thereabout and engaging the interior passage of the second insert.

17. The tool of claim 1, wherein the controller comprises:

a valve disposed on the housing and controlling fluid communication through the first port;

a sensor disposed in the bore and generating one or more sensor signals in response to one or more sensing elements brought in proximity thereto; and control circuitry operatively coupled to the sensor and the valve, the control circuitry activating the valve based on the one or more sensor signals generated by the sensor as the predetermined signal, the valve activated from a closed condition to an opened condition, the closed condition restricting fluid communication through the first port, the opened condition permitting fluid communication through the first port.

18. A wellbore fluid treatment system, comprising:

a plurality of plugs deploying down a tubing string;

a first sliding sleeve deploying on the tubing string, the first sliding sleeve detecting passage of one or more of the plugs through the first sliding sleeve and activating a catch in response to a first detected number of the one or more plugs, the catch engaging a given one of the plugs passing in the first sliding sleeve once activated, the first sliding sleeve opening fluid communication between the tubing string and an annulus in response to fluid pressure applied down the tubing string to the given plug engaged in the catch; and a second sliding sleeve deploying on the tubing string uphole from the first sliding sleeve, the second sliding sleeve detecting passage of one or more of the plugs and activating a catch in response to a second detected number of the one or more plugs, the catch engaging a given one of the plugs passing in the second sliding sleeve once activated, the second sliding sleeve opening fluid communication between the tubing string and the annulus in response to fluid pressure applied down the tubing string to the given plug engaged in the catch, wherein at least one of the first or second sliding sleeves comprises:

a first insert disposed in a bore and movable from a first position to a second position in response to fluid pressure from a first port;

a second insert movably disposed in the bore relative to a second port, the second insert having the catch for moving the second insert, the catch disposed in an interior passage of the second insert, the catch having an inactive condition engaged by a portion of the first insert when the first insert has the first position, the catch having a default active condition disengaged by the portion of the first insert and exposed in the bore when the first insert moves toward the second position, the second insert movable from a closed condition restricting fluid communication through the second port to an opened condition permitting fluid communication through the second port; and a controller opening fluid communication through the first port in response to the detected number of the one or more plugs.

19. The system of claim 18, wherein the catch of the at least one first or second sliding sleeves is activated at a predetermined time interval after the detected number of the one or more plugs.

20. The system of claim 18, further comprising:

a third sliding sleeve deploying on the tubing string between the first and second sliding sleeves, the third sliding sleeve having an insert movable relative to a port, the insert having a seat disposed therein, the insert opening fluid communication between the tubing string and the annulus via the port in response to fluid pressure applied down the tubing string to one of the plugs engaged in the seat.

21. The system of claim 18, wherein the plurality of plugs comprises first and second plugs of different sizes.

22. A wellbore fluid treatment method, comprising;

deploying sliding sleeves on a tubing string in a wellbore, each sliding sleeve set to activate a catch therein after detecting passage of a predetermined number of plugs therethrough;

counting one or more first plugs deployed down the tubing string as they pass through the sliding sleeves;

activating a first catch on a first of the sliding sleeves automatically in response to the passage of the predetermined number of the one or more first plugs in the first sliding sleeve by:

opening fluid pressure through a first port in the first sliding sleeve, moving a first insert in the first sliding sleeve in response to the fluid pressure from the first port, disengaging the first insert from the first catch in an inactive condition engaged by a portion of the first insert, and exposing the first catch in the first sliding sleeve to a default active condition disengaged by the first insert;

landing a second plug deployed down the tubing string on the activated first catch; and opening a second insert relative to a second port in the first sliding sleeve by pumping fluid through the tubing string against the second plug landed in the first catch in the first sliding sleeve.

23. The method of claim 22, further comprising:

activating a second catch on a second of the sliding sleeves automatically in response to passage of the second plug;

landing a third plug deployed down the tubing string on the activated second catch; and opening the second sliding sleeve by pumping fluid through the tubing string against the third plug in the second sliding sleeve.

24. A downhole flow tool, comprising:

a housing having a bore and defining first and second ports communicating the bore outside the housing;

a first insert disposed in the bore and movable from a first position to a second position in response to fluid pressure from the first port;

a second insert movably disposed in the bore relative to the second port, the second insert having a first catch for moving the second insert, the first catch having an inactive condition when the first insert has the first position, the first catch having an active condition when the first insert moves toward the second position, the second insert movable from a closed condition restricting fluid communication through the second port to an opened condition permitting fluid communication through the second port; and a controller comprising a sensor, a timer, and a valve, the sensor responsive to passage of a sensing element relative thereto, the timer activating a predetermined time interval in response to a response by the sensor, the valve activated in response to passage of the predetermined time interval and opening fluid communication through the first port.

25. The tool of claim 24, wherein the sensor comprises a hall effect sensor responsive to magnetic material of the sensing element.

26. The tool of claim 24, wherein the valve comprises a solenoid valve having a plunger movable relative to the first port.

27. The tool of claim 24, wherein the first catch comprises a profile defined in the interior passage of the second insert, the profile in the inactive condition being covered by the portion of the first insert in the first position, the profile in the active condition being exposed.

28. The tool of claim 27, further comprising a plug having at least one biased key disposed thereon, the at least one biased key engaging the profile in the active condition.

29. The tool of claim 24, wherein the first catch comprises at least one key disposed thereon and biased toward the interior passage of the second insert, the at least one key in the inactive condition being retracted from the interior passage by the portion of the first insert in the first position, the at least one key in the active condition being extended into the interior passage.

30. The tool of claim 29, further comprising a plug having a profile engaging the at least one key in the active condition.

31. The tool of claim 24, wherein the second insert moves from the closed condition to the opened condition in response to fluid pressure activating against a plug engaged by the first catch in the active condition.

32. The tool of claim 24, further comprising a plug deployable through the bore of the housing and through the interior passage in the second insert, the plug having a sensing element initiating the predetermined signal of the controller when deployed in proximity thereto.

33. The tool of claim 32, wherein the plug comprises a second catch adapted to engage the first catch in the active condition and adapted to pass the first catch in the inactive condition.

34. A downhole flow tool, comprising:

a housing having a bore and defining first and second ports communicating the bore outside the housing;

a first insert disposed in the bore and movable from a first position to a second position in response to fluid pressure from the first port;

a second insert movably disposed in the bore relative to the second port, the second insert having a catch for moving the second insert, the catch comprising a profile defined in an interior passage of the second insert, the profile having an inactive condition being covered by a portion of the first insert when the first insert has the first position, the profile having an active condition being exposed when the first insert moves toward the second position, the second insert movable from a closed condition restricting fluid communication through the second port to an opened condition permitting fluid communication through the second port; and a controller opening fluid communication through the first port in response to a predetermined signal.

35. The tool of claim 34, wherein the controller comprises a sensor responsive to passage of a sensing element relative thereto.

36. The tool of claim 35, wherein the sensor comprises a hall effect sensor responsive to magnetic material of the sensing element.

37. The tool of claim 35, wherein the controller comprises:

a counter counting one or more responses of the sensor and comparing the one or more responses to a predetermined count; and a valve activated by the controller when the one or more responses at least meet the predetermined count and opening fluid communication through the first port.

38. The tool of claim 34, wherein the controller comprises a solenoid valve having a plunger movable relative to the first port.

39. The tool of claim 34, further comprising a plug deployable through the bore of the housing and having at least one biased key disposed thereon, the at least one biased key engaging the profile in the active condition.

40. The tool of claim 39, wherein the at least one key has one or more notches defined thereon, the one or more notches locking in the profile in only a first direction tending to open the second insert, the one or more notches permitting the plug to move in a second direction opposite to the first direction.

41. The tool of claim 39, wherein the plug comprises a seal disposed thereabout and engaging the interior passage of the second insert.

42. The tool of claim 34, wherein the second insert moves from the closed condition to the opened condition in response to fluid pressure activating against a plug engaged by the catch in the active condition.

43. The tool of claim 34, further comprising a plug deployable through the bore of the housing and through the interior passage in the second insert, the plug having a sensing element initiating the predetermined signal of the controller when deployed in proximity thereto.

44. The tool of claim 43, wherein the plug comprises at least one key biased thereon adapted to engage the catch in the active condition and adapted to pass the catch in the inactive condition.

45. A downhole flow tool, comprising:

a housing having a bore and defining first and second ports communicating the bore outside the housing;

a first insert disposed in the bore and movable from a first position to a second position in response to fluid pressure from the first port;

a second insert movably disposed in the bore relative to the second port, the second insert having an interior passage and having a catch for moving the second insert, the catch having an inactive condition when the first insert has the first position, the catch having an active condition when the first insert moves toward the second position, the second insert movable from a closed condition restricting fluid communication through the second port to an opened condition permitting fluid communication through the second port;

one or more plugs deployable through the bore of the housing and through the interior passage of the second insert, the one or more plugs having one or more sensing elements; and a controller opening fluid communication through the first port in response to a predetermined signal from the one or more sensing elements of the one or more plugs.

46. The tool of claim 45, wherein the controller comprises a sensor responsive to passage of the one or more sensing elements relative thereto.

47. The tool of claim 46, wherein the sensor comprises a hall effect sensor responsive to magnetic material of the one or more sensing elements.

48. The tool of claim 47, wherein the controller comprises:

a counter counting one or more responses of the sensor and comparing the one or more responses to a predetermined count; and a valve activated by the controller when the one or more responses at least meet the predetermined count and opening fluid communication through the first port.

49. The tool of claim 45, wherein the controller comprises a solenoid valve having a plunger movable relative to the first port.

50. The tool of claim 45, wherein the catch comprises at least one key disposed thereon and biased toward the interior passage of the second insert, the at least one key in the inactive condition being retracted from the interior passage by a portion of the first insert in the first position, the at least one key in the active condition being extended into the interior passage; and wherein at least one of the one or more plugs engages the at least one key in the active condition.

51. The tool of claim 45, wherein the second insert moves from the closed condition to the opened condition in response to fluid pressure activating against at least one of the one or more plugs engaged by the catch in the active condition.

52. The tool of claim 45, wherein at least one of the one or more plugs comprises at least one key biased thereon adapted to engage the catch in the active condition and adapted to pass the catch in the inactive condition.

* * * * *